United States Patent [19]

Schilling et al.

[11] Patent Number: 4,747,349

[45] Date of Patent: May 31, 1988

[54] APPARATUS FOR LAUNCHING BY A BULLET AMMUNITION SUCH AS A GRENADE HAVING A TRAILING TUBE TO PROVIDE A FLAT TRAJECTORY OF FIRE

[75] Inventors: Michel Schilling, Chateauneaf s/Cher; Luc Mitard, St Denis De Palin, both of France

[73] Assignee: Luchaire S.A., Paris, France

[21] Appl. No.: 939,302

[22] Filed: Dec. 5, 1986

Related U.S. Application Data

[63] Continuation of Ser. No. 687,428, Dec. 28, 1984, abandoned.

[51] Int. Cl.[4] ..... F42B 11/42

[52] U.S. Cl. ..... 102/485

[58] Field of Search ..... 102/484, 485; 42/105

[56] References Cited

U.S. PATENT DOCUMENTS

| | | | |
|---|---|---|---|
| 3,934,513 | 1/1976 | Gabriëls . | |
| 4,567,831 | 2/1986 | Gordon et al. | 102/485 |

FOREIGN PATENT DOCUMENTS

| | | | |
|---|---|---|---|
| 891151 | 5/1982 | Belgium . | |
| 714636 | 11/1931 | France . | |
| 1599746 | 8/1970 | France . | |
| 2262275 | 9/1975 | France . | |
| 2517424 | 6/1983 | France | 102/485 |
| 2517820 | 6/1983 | France | 102/485 |

*Primary Examiner*—Harold J. Tudor

*Attorney, Agent, or Firm*—Wenderoth, Lind & Ponack

[57] ABSTRACT

A bullet trap device for launching, by firing a live bullet, ammunition such as a grenade having a trailing tube to impart thereto a flat trajectory of fire, includes a body to receive the impact of the live bullet, a supporting piece for positioning the body within the trailing tube of the grenade, and a shock absorber part positioned axially between the body and a portion of the supporting piece. The body and the shock absorber parts are formed as an integral, one-piece, solid-forged assembly. A centering ring, separate from the supporting piece, is positioned radially between the shock absorber part and the supporting piece, thereby maintaining the body and the shock absorber part centrally of the axis of the trailing tube of the grenade after firing.

2 Claims, 1 Drawing Sheet

APPARATUS FOR LAUNCHING BY A BULLET AMMUNITION SUCH AS A GRENADE HAVING A TRAILING TUBE TO PROVIDE A FLAT TRAJECTORY OF FIRE

This application is a continuation of application Ser. No. 687,428, filed Dec. 28, 1984, now abandoned.

BACKGROUND OF THE INVENTION

The present invention relates to improvements in or relating to a device, commonly called a bullet trap, designed to throw or launch ammunition, such as a grenade having a trailing tube to provide a flat trajectory of fire, by means of a live bullet.

As shown at A in FIG. 2 of the accompanying drawings, such device conventionally includes a body a situated in the axis of fire to absorb the impact of the bullet and housed in a supporting piece b with the interposition of a shock absorber consisting of a washer c. At its rear surface the body a has an entrance opening with a generally conical shape.

As can be seen in FIG. 1, the device A is positioned within a trailing tube d of a grenade B with fuse e of the grenade in front of device A.

In practical use, this known bullet trap cannot absorb an amount of energy higher than about 2,000 joules, which amounts to saying that such bullet trap can be used only with small-caliber arms (e.g., 5.56 mm).

SUMMARY OF THE INVENTION

The invention provides an improved bullet trap that can be used with arms of a caliber (7.62 mm) higher than employable with such known bullet trap, while ensuring a perfect centering of the bullet trap after firing.

The improved bullet trap according to the invention, which is used to throw or launch ammunition such as a grenade having a trailing tube to provide a flat trajectory of fire by means of a live bullet, comprises an integral, one-piece solid-forged assembly situated in the axis of fire of the bullet and housed in a supporting piece. Such assembly includes a body absorbing the impact of the bullet and a part forming a shock absorber. A centering ring is interposed between the shock absorber part and the supporting piece of the bullet trap to ensure perfect centering of the bullet trap after firing.

According to a feature of the invention, a powder charge is disposed concentrically around the body of the bullet trap to transmit to the fuse, for loading the grenade, the gases that are released by the charge which is ignited the moment the ammunition is fired.

According to another feature of the invention, the body of the bullet trap has, starting from the diameter of the bullet, an initially truncated and then a cylindrical guide hole extending through a large part of the body, the exterior surface of which also is cylindrical.

BRIEF DESCRIPTION OF THE DRAWINGS

Various features and advantages of the invention will become apparent from the following description of one embodiment thereof, given solely by way of non-limitative example, with reference to the accompanying drawings, wherein.

DETAILED DESCRIPTION OF THE INVENTION

Figure 1:
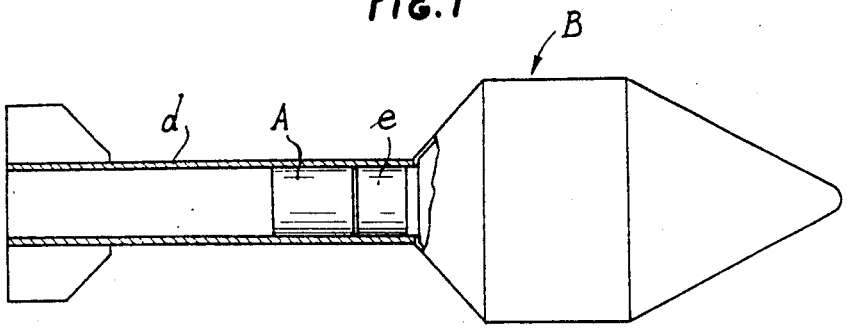
FIG. 1 is a partially sectional view of a grenade to be launched.
Figure 2:
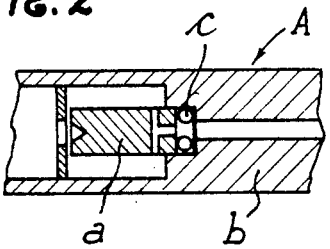
FIG. 2 is an axial sectional view of a conventional bullet trap employed in such grenade.
Figure 3:
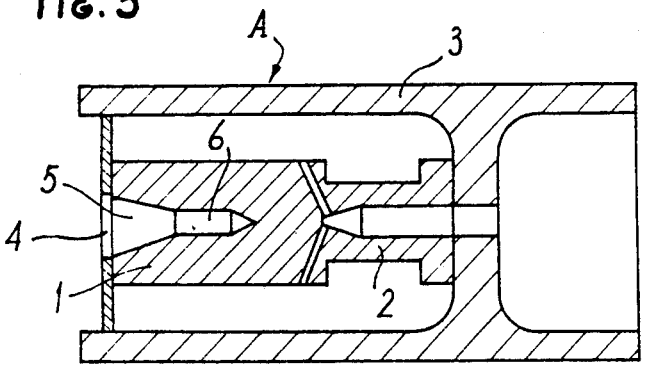
FIGS. 3 and 4 are similar views, on an enlarged scale, of an improved bullet trap according to the invention.
Figure 4:
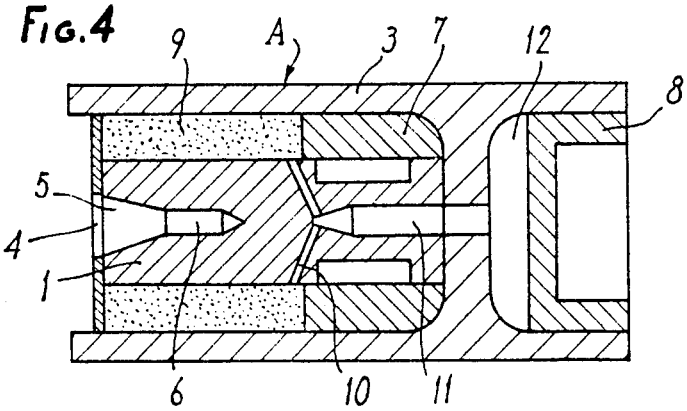

The bullet trap A of the invention includes a rear body 1 and a part 2 forming a shock absorber in the form of an integral, one-piece, solid-forged assembly. This assembly permits the absorption of a sufficient amount of energy so as to communicate to a supporting piece 3, within which the assembly is positioned, only a reduced force that produces a stress compatible with the resistance of piece 3. Moreover, such construction results in a reduction of the number of pieces to be fabricated, as well as in a simplification of the shape and, thereby, in a reduction of the cost of the bullet trap.

As soon as a bullet enters the bullet trap, it must not only be braked, but also guided, in order not to deviate from the axis of the bullet trap as it plunges into an entrance hole 4 thereof.

To prevent the body of the bulletin trap from distending too much, the bullet must be guided over a relatively long distance in order to distribute the deformation over an as large a surface as possible and to bring about a maximum absorption of energy.

According to the invention, these objects are achieved by providing in the body 1 of the bullet trap a guide hole having an initially truncated portion 5 and then a cylindrical portion 6. Such guide hole extends over a large part of the actual body 1, the exterior surface of which also is generally cylindrical.

The shock absorber part 2 of the bullet trap and the supporting piece 3 must be calculated and set up in such a way as to optimize the respective resistances of these two members. The shock absorber part 2 must, in fact, absorb the remaining energy that has not been consumed by the deformation and heating of the body 1 of the bullet catcher. The resistance to compression of part 2 must range between two limits between which it is possible to consume only the energy of the bullet. If the resistance of the shock absorber part 2 is too small, it will consume only a part of the remaining energy and the supporting piece 3 will therefore have to absorb the remaining energy. To do this, piece 3 will have to have large dimensions in order to be able to offer the necessary resistance, and this would result in an undesirable increase of its mass. However, if the resistance of the shock absorber part 2 is too high, it will not absorb any energy and, again, the supporting piece will have to absorb such energy.

After the bullet has been stopped by the bullet trap, the length of the bullet trap will be considerably reduced because of the crushing of part 2 that forms the shock absorber. Moreover, the front surface supporting the bullet trap will be deformed and the bullet trap will be off-center and corkscrewed due to the absorption of the bullet's energy of rotation. The result will be a disturbing imbalance of the normal trajectory of the ammunition, i.e. the grenade.

The invention overcomes this drawback by interposing between the bullet trap and the supporting piece 3 a ring 7 which enable the bullet trap to maintain its perfect centering after firing. Ring 7 is positioned radially outwardly of the shock absorber part 2 of the bullet trap and must be able to support bulging of the bullet trap. Thus, ring 7 can be made of a plastic material.

According to the invention, to effect loading of the fuse housed in a latch 8 of the ammunition such as a grenade soon after its launching, a charge of make-up powder 9 is disposed in a space between the body 1 of the bullet trap and the supporting piece 3. The gases released by the combustion of charge 9 are routed to the fuse through vents 10 formed in the bullet trap communicating with a duct 11 formed both in the shock absorber part 2 and in the supporting piece 3 and extending into a chamber 12 communicating with the fuse.

We claim:

1. In a bullet trap device for launching, by firing of a live bullet, ammunition such as a grenade having a trailing tube to impart thereto a flat trajectory of fire, such device being of the type including a body adopted to receive directly the impact of a live bullet, a tubular supporting piece for positioning said body within the trailing tube of ammunition to be launched, and a shock absorber part positioned axially between said body and a portion of said supporting piece for absorbing the impact of the live bullet, the improvement:

wherein said body is substantially cylindrical and said body and said shock absorber part comprise an integral, one-piece, solid-forged assembly with said shock absorber part having an outer size reduced from and smaller than the outer size of said body;

said portion of said supporting piece comprises a web integral with said supporting piece, with said shock absorber part abutting said web;

said shock absorber part having a resistance to compression lower than that of said web and being capable of bulging and crushing on said web under the effect of the impact of the live bullet;

an annular space provided between said tubular supporting piece and said assembly constituted by said body and said shock absorber part; and centering ring means, separate from said supporting piece and positioned in said annular space radially between said shock absorber part and said supporting piece, for limiting bulging of said shock absorber part for maintaining said body and said shock absorber part centrally of the axis of the trailing tube of the ammunition after firing.

2. The improvement claimed in claim 1, wherein said body has formed therein a guide hole for receiving the live bullet, said guide hole extending through a major portion of the axial length of said body, said guide hole including a rearward truncated portion and a forward cylindrical portion, and said body has a cylindrical exterior surface.

* * * * *